US006282839B1

(12) United States Patent
Fischer et al.

(10) Patent No.: US 6,282,839 B1
(45) Date of Patent: Sep. 4, 2001

(54) CABLE-ACTUATED WINDOW LIFTER

(75) Inventors: Bernd Fischer, Coburg; Werner Kindler, Untersiemau; Ottmar Hütter, Meeder, all of (DE)

(73) Assignee: Brose Fahrzeugteile GmbH & Co., KG Coburg, Coburg (DE)

( * ) Notice: Subject to any disclaimer, the term of this patent is extended or adjusted under 35 U.S.C. 154(b) by 0 days.

(21) Appl. No.: 09/380,636

(22) PCT Filed: Mar. 4, 1998

(86) PCT No.: PCT/DE98/00684

§ 371 Date: Sep. 3, 1999

§ 102(e) Date: Sep. 3, 1999

(87) PCT Pub. No.: WO98/39544

PCT Pub. Date: Sep. 11, 1998

(30) Foreign Application Priority Data

Mar. 4, 1997 (DE) ..... 197 11 046

(51) Int. Cl.[7] ..... E05F 11/48

(52) U.S. Cl. ..... 49/352; 242/615.2; 222/190; 474/120; 254/393

(58) Field of Search ..... 49/352, 348, 349; 242/615.2, 615.3, 615.4; 222/190; 474/120; 254/393

(56) References Cited

U.S. PATENT DOCUMENTS

| | | | | |
|---|---|---|---|---|
| 1,471,726 | * | 10/1923 | Ginty | 474/120 X |
| 1,749,146 | | 3/1930 | Maison . | |
| 3,762,229 | * | 10/1973 | Johnson | 474/120 X |
| 4,691,475 | | 9/1987 | Maekawa | 49/352 |
| 5,033,233 | * | 7/1991 | Suzumura | 49/352 |
| 5,333,411 | * | 8/1994 | Tschirschwitz et al. | 49/352 |
| 5,740,630 | * | 4/1998 | Medebach | 49/352 |

FOREIGN PATENT DOCUMENTS

| | | | | |
|---|---|---|---|---|
| 2518860 | * | 11/1976 | (DE) | 474/120 |
| 31 36 890 | | 4/1983 | (DE) . | |
| 35 45 083 | | 6/1986 | (DE) . | |
| 42 40 030 | | 6/1994 | (DE) . | |
| 22831 | * | 2/1918 | (DK) | 474/120 |

* cited by examiner

*Primary Examiner*—Jerry Redman
(74) *Attorney, Agent, or Firm*—Christie, Parker & Hale, LLP

(57) ABSTRACT

A cable deflection pulley pertaining to a window lifter comprising a drive unit, a guide rail for a driver which is connected to the window and to the cable, and cable deflection pulleys with a guide or bearing groove for the cable. The device has an axially directed assembly groove in the proximity of the bearing groove to facilitate and accelerate assembly and to reduce the amount of cable required. The assembly groove contains an area adjacent to the axis of the cable deflection pulley, and an area adjacent to the bearing groove, through which the cable is pulled from the assembly groove into the bearing groove.

11 Claims, 3 Drawing Sheets

CABLE-ACTUATED WINDOW LIFTER

FIELD OF THE INVENTION

The invention relates to a cable window lifter.

BACKGROUND OF THE INVENTION

Single or multi-strand cable window lifters are known, particularly for motor vehicles, which comprise a drive unit which has a manual or motorized drive and a drive drum, a guide rail or several guide rails for one or more drivers, which are connected to a window pane, and a cable wound round the drive drum, and several cable deflection pulleys. The cable deflection pulleys have a guide or bearing groove in which the cable is guided and deflected.

FIG. 1 shows, as an example, a single-strand cable window lifter for raising and lowering a window pane 7 which is set in a driver 6. The driver 6 is connected to a cable 4 and is mounted displaceable on a guide rail 5. The cable 4 is wound round a cable drum 3 of a drive unit 1, which in the illustrated embodiment has an electric motor 2 as the drive element. Cable deflection pulleys 8, 9 are mounted at the ends of the guide rail 5 and deflect the cable 4, which is guided in the area of the guide rail 5 parallel to the guide rail 5, towards the cable drum 3 where the cable 4 is wound one or more times round the cable drum 3 and is connected to same. Through rotation of the cable drum 3 in the one or other rotary direction the driver 6 is raised or lowered together with the window pane 7 on the guide rail 5.

FIG. 2 shows in an enlarged individual representation, the cable deflection pulley 8 which is mounted at the upper end of the guide rail 5 according to FIG. 1. The cable deflection pulley 8 has an axial bore 80 which is pushed onto an axle which is provided with the guide rail 5 or with a fastening element connected to the guide rail 5. Several webs 81 connect the wall of the axial bore 80 to the wall of a guide or bearing groove 82 in which the cable 4 is guided and deflected.

The cable 4 is connected in frictional engagement to the cable drum 3 or to the ends of the cable drum through positive locking elements. In the 'relaxed' state of the cable window lifter, the cable has a cable slack which can lead to undefined motion states of the driver 6, and thus, of the window pane 7, as well as to considerable noise and accelerated material fatigue, and ultimately, to system failure. To remove the cable slack, the cable is tautened and is pushed in this tautened state, that is with a corresponding cable length or through the arrangement of spring elements, onto the cable deflection pulleys 8, 9 according to FIG. 1.

In order to facilitate the insertion of the cable 4 into the guide grooves of the cable deflection pulleys 8, 9 according to FIG. 1, it is known to provide at least one of the cable deflection pulleys with a notch 83 according to FIG. 2 into which the cable 4 is inserted and introduced into the guide groove 82 through further rotation of the cable guide pulley 8.

Through the sharp angling of the cable 4 during insertion into the notch 83, however, there is the danger of damage to the cable through it becoming spliced or bent. Because this cable area is then always moved in the deflection area of the cable deflection pulley there is also the risk of the initially damaged cable tearing in this area.

Furthermore there is the drawback that the cable is fitted in an unergonomic sequence of movements by rotating the wrist with a simultaneously high amount of force which leads to premature fatigue and damage to the wrist of the fitter.

Furthermore this method of fitting the cable is linked with a time-consuming assembly since first the notch 83 has to be brought into a favorable position for assembly and then the cable has to be inserted into the guide groove while applying a high amount of force.

SUMMARY OF THE INVENTION

The object of the invention is to provide a cable deflection pulley of the type already mentioned which guarantees smooth insertion of the cable into the guide groove of the cable deflection pulley without damaging the material, which allows an ergonomic sequence of movements with minimum effort and which reduces the assembly time.

The solution according to the invention avoids a right angled bending of the cable during insertion into the guide or bearing groove of a cable deflection pulley through a continuous drawing up of the cable from the untautened or slightly tautened state of the cable into the tautened state, as well as an ergonomic sequence of movements with minimum effort and short assembly time.

By arranging a transition area between the bearing groove and the area of the assembly groove adjoining the bearing groove, it is possible to guarantee a resistance-free transition of the cable from the assembly groove into the bearing groove.

As a result of the continuous incline of the side webs of the assembly groove in the transition area in the direction of the guide groove, as well as through a break in the web mounted between the assembly groove and the bearing groove, the change-over of the cable from the assembly groove to the bearing groove is made additionally easier.

Preferably the assembly groove has the contour of a triangle with convex sides (projection of a spherical triangle onto a plane) whose corners are advantageously rounded.

Through this shaping of the assembly groove, the cable which is inserted in the assembly groove entrains the cable deflection pulley when pulling on the cable by a short amount, until the cable passes onto a corner point of the triangle of the triangular shaped contour of the assembly groove, where the cable is slightly bent. As a result of increased friction, the cable is entrained to the small corner section and is inserted over the transition area into the bearing groove.

In a preferred embodiment, the assembly groove has substantially an equilateral triangular shaped contour with rounded corners wherein the base lies close to the axis of the cable deflection pulley and the opposite tip of the triangle opens into the transition area or into the bearing groove.

Through the arrangement of additional clamping areas for the cable in the assembly groove, the friction engagement of the cable with the cable deflection pulley is increased during assembly and thus the insertion of the cable into the bearing groove becomes easier.

BRIEF DESCRIPTION OF THE DRAWINGS

The idea underlying the invention will now be explained in further detail with reference to the embodiment shown in the drawings in which.

DETAILED DESCRIPTION OF THE PREFERRED EMBODIMENTS

Figure 1:
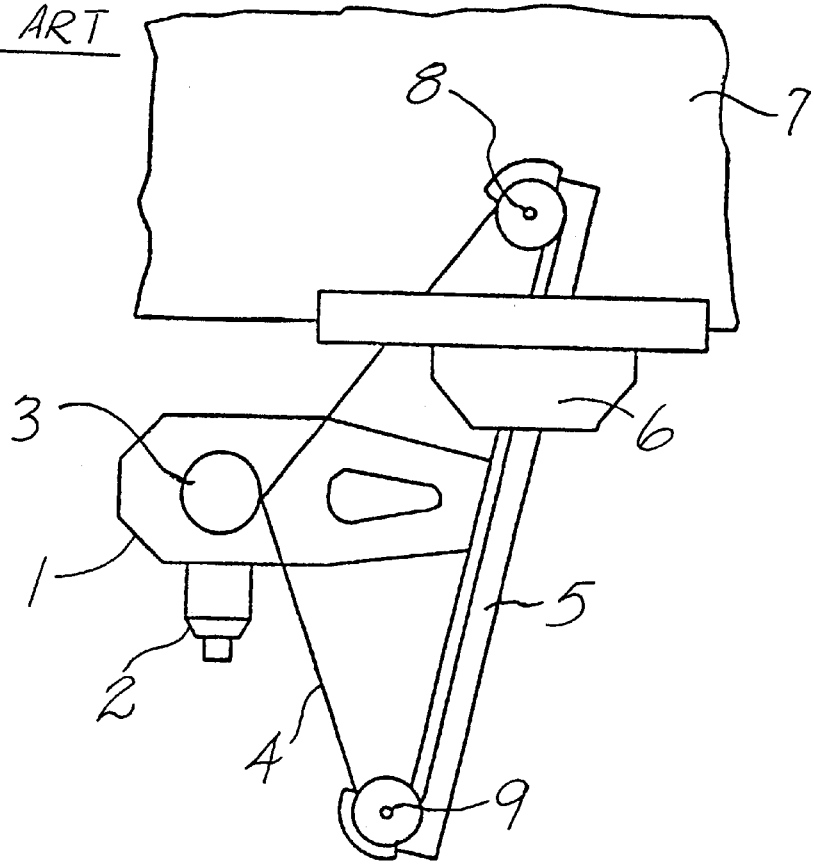
Fig. 1 PRIOR ART
FIG. 1 is a diagrammatic view of the individual parts of a single-strand cable window lifter according to the prior art.
Figure 2:
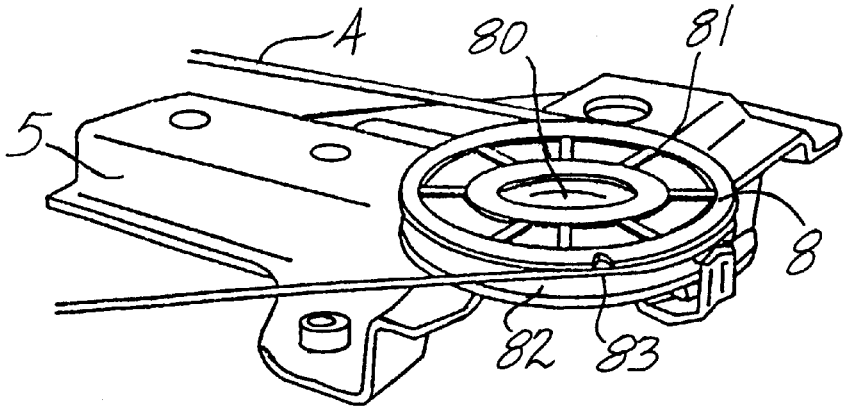
Fig. 2 PRIOR ART
FIG. 2 shows an enlarged view of a cable deflection pulley according to FIG. 1.
Figure 3:
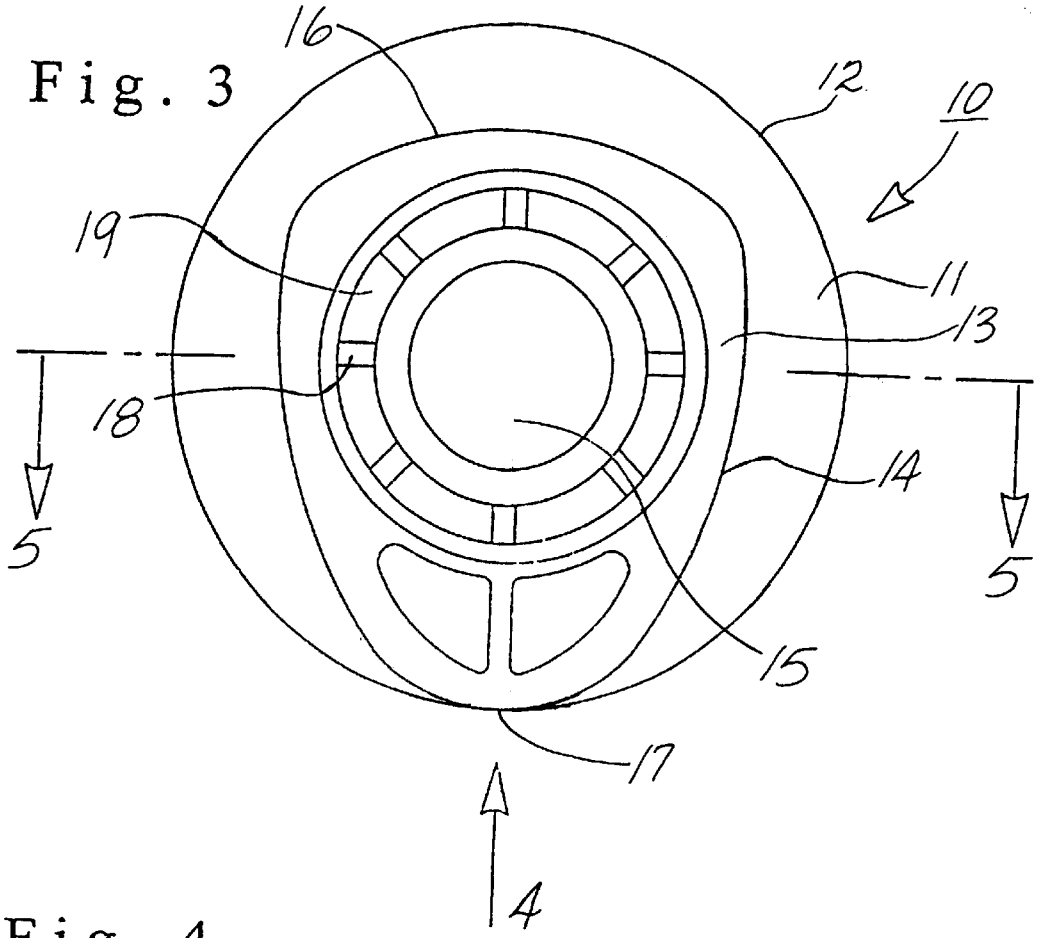
FIG. 3 shows a plan view of a cable deflection pulley according to the invention with assembly and guide grooves.
Figure 4:
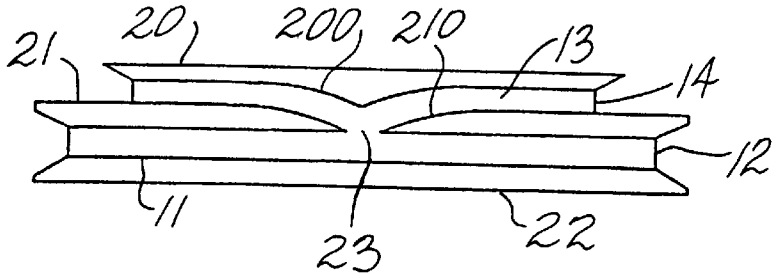
FIG. 4 shows a view of the cable deflection pulley according to FIG. 3 in the direction of arrow IV.
Figure 5:
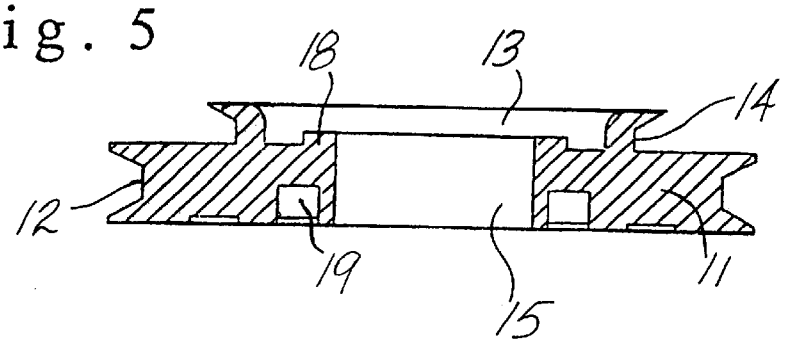
FIG. 5 shows a sectional view through the cable deflection pulley according to FIG. 3 along the line V—V.
Figure 6:
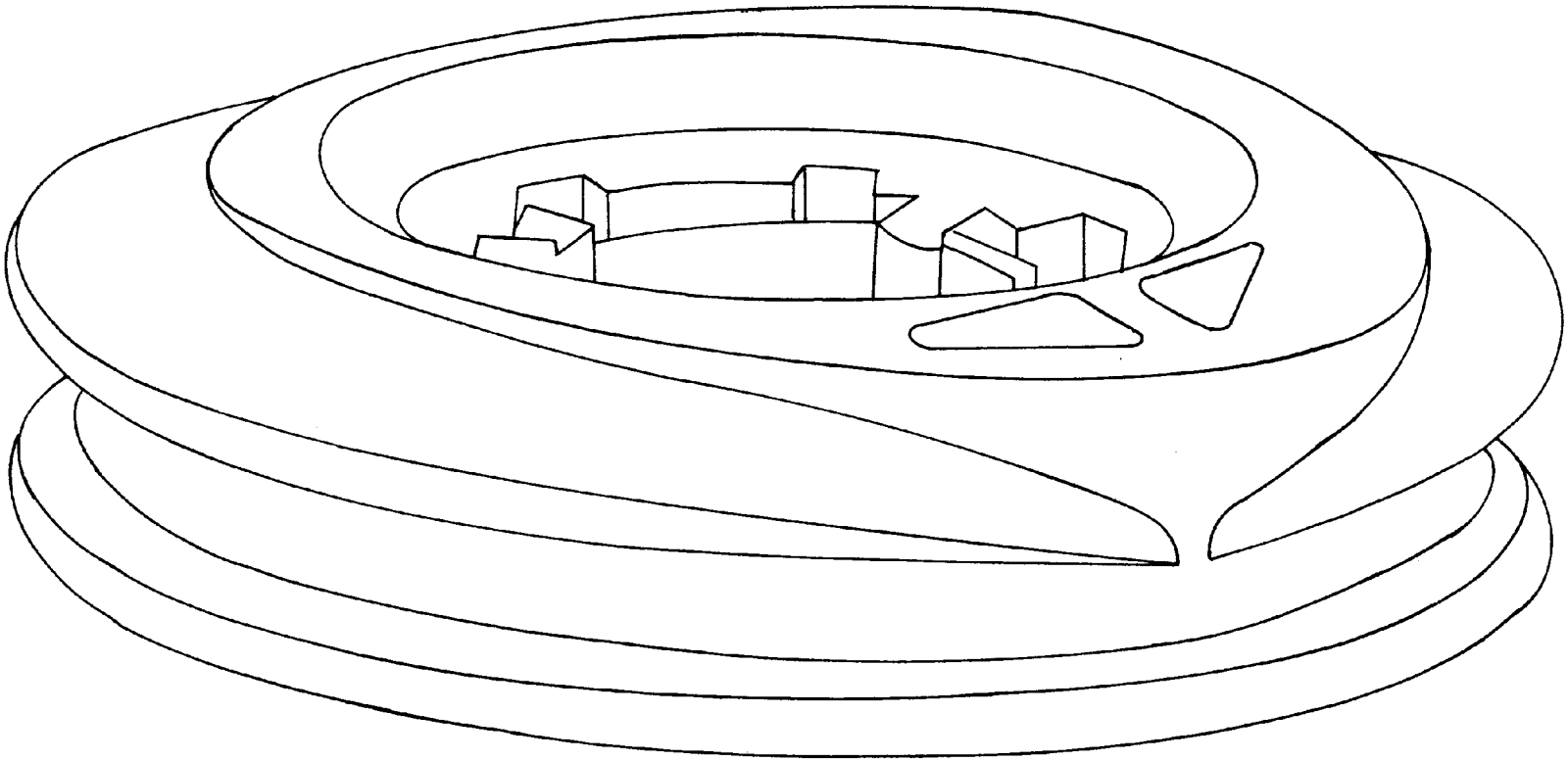
FIG. 6 shows a diagrammatic perspective view of a cable deflection pulley formed according to the invention.

The cable deflection pulley 10, shown in plan view in FIG. 3, in an end side view in FIG. 4, in cross-section in FIG. 5, and in perspective in FIG. 6 has a cylindrical basic member 11 with an axis or axial bore 15 and a peripheral bearing groove (or roller) 12 formed in the cylinder wall. The roller 12 serves to hold the cable in the deflection area and is defined by side webs 21 and 22. An assembly body 13 is mounted on one side of the cylindrical basic member 11 and has the contour of an equilateral triangle with convex, i.e. outwardly curved sides, as well as rounded corners. An assembly groove 14 is provided on the periphery of the assembly body 13 and is defined at the side by webs 20, 21 according to FIG. 4.

The base 16 of the equilateral triangle is located close to the axis 15, while the opposite rounded tip 17 of the equilateral triangle of the assembly body 13 aligns with the outer contour of the basic member 11, so that the assembly groove 14 opens in a transition area 23 into the bearing groove 12.

The outer web 20 defining the assembly groove 14 is inclined, in the transition area 23 in an area 200, towards the bearing groove 12. The web 21 which separates the assembly groove 14 from the bearing groove 12 in an area 210, which is broken in the transition area 23, is also inclined.

To fit a cable and insert the cable into the bearing groove 12, the cable is placed in the assembly groove 14 in the area of the base 16 of the equilateral triangle of the assembly body 13, where the loop of the cable is shortened as a result of its closeness to the axis 15. By pulling the cable in one or other direction or by turning the drive unit of the cable window lifter, the cable drives the cable deflection pulley 10 and is slightly bent in at the corner points of the equilateral triangle so that the friction connection between the cable and assembly groove 14 is increased as a result of the small surface section. The cable is placed over one of the two arms of the equilateral triangle and is drawn in the transition area 23 into the bearing groove 12. Since in the assembled state of the cable, the bearing grooves of the cable deflection pulleys lie in one plane, the cable jars in this position without falling back onto the assembly groove.

Through a corresponding shaping of the assembly groove 14 or by applying indented clamping areas, the friction connection between the cable and assembly groove 14 can be increased during fitting of the cable and thus insertion of the cable into the bearing groove 12 is made easier.

It is within the scope of the present invention that the cable passes through rotation of the cable deflection pulley 10 from the assembly groove 14 into the bearing groove 12. The end sides of the cable deflection pulley are provided, for example, with indentations 19 mounted between the webs 18. A corresponding shaped tool engages with keyed connection into the indentations 19. The shaped tool is turned by a leverage connection to rotate the cable deflection pulley in the desired direction to insert the cable into the bearing groove 12.

For easier fitting, however, a tensile force is preferably exerted on the cable so that this is brought from the assembly groove 14 over the transition area 23 into the bearing groove 12. For making fitting even easier, the fitting body 13 is mounted on either side of the basic member 11 so that no corresponding side orientation of the cable deflection pulley 10 is required during fitting.

With a corresponding design of the cable and geometry of the cable window lifter it can be sufficient if one of the several cable deflection pulleys is formed according to the invention while the other cable deflection pulleys have no assembly aid. However all cable deflection pulleys are preferably fitted with the assembly aid according to the invention in order to shorten the assembly time and make fitting easier overall.

What is claimed is:

1. A cable window lifter for lifting a window pane comprising:

a cable;

drive unit;

a driver connected to the cable and adapted to be connected to the window pane;

a guide rail for the driver; and cable deflection pulleys having a first cable deflection pulley and a second cable deflection pulley, each pulley with a bearing groove for the cable, wherein the bearing grooves of the cable deflection pulleys lie in one common plane and configured to maintain the cable in the bearing groove during rotation;

wherein the second cable deflection pulley has an assembly groove mounted eccentrically next to the bearing groove in an axial direction of the pulley;

wherein the assembly groove has a first area close to an axis of the cable deflection pulley, and a second area further from the axis wherein the assembly groove adjoins the bearing groove forming a transition area, wherein when the cable is in the bearing groove of the first cable deflection pulley and placed along the first area of the assembly groove of the second cable deflection pulley, and when the second cable deflection pulley is rotated around its rotation axis, the cable is pulled from the assembly groove to the bearing groove of the second cable deflection pulley.

2. The cable window lifter according to claim 1 wherein the assembly groove has two webs, each inclined towards the bearing groove; and wherein one of the two webs is between the assembly groove and the bearing groove and is interrupted in the transition area.

3. The cable window lifter according to at least one of the preceding claims wherein the assembly groove has a contour of a triangle with convex sides.

4. The cable window lifter according to claim 3 wherein the triangle has corners which are rounded.

5. The cable window lifter according to claim 3 wherein the contour of the assembly groove consists of an equilateral triangle with a base forming the first area close to the axis of the cable deflection pulley and a corner lying between arms of the triangle, wherein the corner forms the second area.

6. The cable window lifter according to claim 5 wherein the axis is located between the corner and the base.

7. The cable window lifter according to claim 1 wherein the assembly groove has at least one clamping area for the cable.

8. The cable window lifter according to claim 1 wherein the pulley has an engagement indentation for positive locking connection with an assembly tool, wherein the indentation is on at least one side of the cable deflection pulley.

9. The cable window lifter according to claim 8 wherein the pulley has several web-like spokes arranged between the axis and a periphery of the cable deflection pulley, wherein the engagement indentation is formed from the spokes.

10. The cable window lifter according to claim 1 wherein the assembly groove is mounted on either side of the cable deflection pulley.

11. The cable window lifter according to claim 1 wherein all the cable deflection pulleys of the cable window lifter are provided with an assembly groove.

* * * * *

UNITED STATES PATENT AND TRADEMARK OFFICE

CERTIFICATE OF CORRECTION

PATENT NO. : 6,282,839 B1 
DATED : September 4, 2001
INVENTOR(S) : Bernd Fischer, Werner Kindler and Ottmar Hütter It is certified that error appears in the above-identified patent and that said Letters Patent is hereby corrected as shown below:

Title page,
Item [56], References Cited, FOREIGN PATENT DOCUMENTS, insert the following reference: -- 926982 5/1963 (GB) --.

Column 4,
Line 25, before "drive unit" insert -- a --.

Signed and Sealed this

Fourth Day of February, 2003

JAMES E. ROGAN
*Director of the United States Patent and Trademark Office*